US009365403B2

(12) United States Patent
Vorwerk

(10) Patent No.: US 9,365,403 B2
(45) Date of Patent: Jun. 14, 2016

(54) METHOD AND FILLING MACHINE FOR THE OPEN JET FILLING OF BOTTLES OR SIMILAR CONTAINERS

(75) Inventor: Jürgen Vorwerk, Morsdorf (DE)

(73) Assignee: KHS GmbH, Dortmund (DE)

( * ) Notice: Subject to any disclaimer, the term of this patent is extended or adjusted under 35 U.S.C. 154(b) by 289 days.

(21) Appl. No.: 14/009,541

(22) PCT Filed: Mar. 2, 2012

(86) PCT No.: PCT/EP2012/000912

§ 371 (c)(1),
(2), (4) Date: Oct. 3, 2013

(87) PCT Pub. No.: WO2012/139684

PCT Pub. Date: Oct. 18, 2012

(65) Prior Publication Data

US 2014/0014224 A1 Jan. 16, 2014

(30) Foreign Application Priority Data

Apr. 12, 2011 (DE) ..... 10 2011 016 760

(51) Int. Cl.
*B67C 3/04* (2006.01)
*B67C 3/26* (2006.01)

(52) U.S. Cl.
CPC .... *B67C 3/04* (2013.01); *B67C 3/26* (2013.01)

(58) Field of Classification Search
CPC ..... B67C 3/04
USPC ..... 141/1, 34, 134, 135, 136, 144, 145, 141/152, 170, 171, 176, 239, 256, 268, 270, 141/284
See application file for complete search history.

(56) References Cited

U.S. PATENT DOCUMENTS 3,105,526 A * 10/1963 Hurtig ..... 141/171
3,903,941 A * 9/1975 Eisenberg ..... B65B 37/08 141/171
3,934,627 A * 1/1976 Buick ..... B65B 43/60 141/146
4,126,043 A * 11/1978 Schurmann ..... G01N 1/18 141/34
4,588,001 A * 5/1986 Leonard ..... B67C 3/004 141/145
4,874,114 A * 10/1989 Guigan ..... B01L 3/02 141/34
7,243,483 B2 * 7/2007 Clusserath ..... B67C 3/281 141/290
7,967,038 B2 * 6/2011 Jenne ..... B67C 3/007 141/1

(Continued)

FOREIGN PATENT DOCUMENTS

DE 2301993 7/1973
DE 102006017706 A1 * 10/2007 ..... B67C 3/004

(Continued)

*Primary Examiner* — Mark A Laurenzi
*Assistant Examiner* — Andrew Schmid
(74) *Attorney, Agent, or Firm* — Occhiuti & Rohlicek LLP

(57) ABSTRACT

A method for open jet filling of containers with liquid content using a machine having a rotor that rotates around a machine axis. The rotor carries filling stations, each having a filling element, each having an opening and a container carrier. The carrier holds a container such that its opening is at a selected distance from the dispensing opening. Contents dispensed in a controlled manner by the filling element flow in an open filling jet directed toward the container opening. The method includes compensating for deflection of the filling jet due to centrifugal force acting on it when the rotor rotates by causing controlled relative movement between the filling element and the container. As a result of this movement, the open jet cleanly enters the container through the container opening.

18 Claims, 4 Drawing Sheets

(56) References Cited

U.S. PATENT DOCUMENTS

| | | | | |
|---|---|---|---|---|
| 2003/0037514 | A1* | 2/2003 | Hartness | B65B 21/183 53/471 |
| 2009/0159152 | A1* | 6/2009 | Till | B08B 9/32 141/145 |
| 2009/0314385 | A1* | 12/2009 | Goldbrunner | B67C 3/04 141/83 |
| 2010/0084044 | A1* | 4/2010 | Van Melick | B65B 31/003 141/3 |
| 2010/0147415 | A1* | 6/2010 | Lafond | B08B 9/30 141/34 |
| 2011/0023996 | A1* | 2/2011 | Laumer | B67C 7/0073 141/1 |
| 2012/0090728 | A1* | 4/2012 | Duval | F16L 27/11 141/1 |
| 2013/0105037 | A1* | 5/2013 | Frenal | F16K 1/303 141/1 |
| 2013/0220481 | A1* | 8/2013 | Hartel | B67C 3/045 141/9 |
| 2013/0306190 | A1* | 11/2013 | Tanaka | B67C 3/287 141/1 |
| 2014/0014224 | A1* | 1/2014 | Vorwerk | B67C 3/04 141/1 |

FOREIGN PATENT DOCUMENTS

| | | | |
|---|---|---|---|
| JP | 2003063594 | | 3/2003 |
| JP | 2003063594 | A * | 3/2003 |
| JP | 2006248547 | | 9/2006 |
| JP | 2007261651 | | 10/2007 |
| JP | 2008265851 | | 11/2008 |

* cited by examiner

METHOD AND FILLING MACHINE FOR THE OPEN JET FILLING OF BOTTLES OR SIMILAR CONTAINERS

RELATED APPLICATIONS

This application is the national stage entry, under 35 USC 371, of PCT application PCT/EP2912.999812, filed on May 2, 2013, which, under 35 USC 119, claims the benefit of the priority date of German patent application DE 101011016760.9, filed on Apr. 12, 2011. The contents of the foregoing applications are incorporated herein by reference.

FIELD OF INVENTION

The invention concerns a method and apparatus for open jet filling.

BACKGROUND

A drawback of open-jet filling is that as the rotor of a filling machine rotates, centrifugal force deflects the open filling-jet outwards and away from this machine axis.

One way to reduce this deflection is to use a very large rotor or to avoid spinning the rotor too fast.

A known way to compensate for the deflection is to make the container's mouth large enough so that even if centrifugal force deflects the jet, it still manages to enter the mouth.

A difficulty with this procedure is that if one uses a wide jet so as to achieve faster filling, there is a high risk of missing the mouth with some part of the jet. A narrow filling jet is less likely to miss the mouth. But one cannot fill as fast with a narrow jet.

SUMMARY

The invention avoids the foregoing drawback and thus improves performance of a filling machine. The invention compensates for centrifugal force so that a wider jet can be used. A wider jet means a higher volumetric flow rate, and hence, faster filling.

According to the invention, compensation for centrifugal force occurs as a result of controlled relative movement between the point at which the jet begins and the mouth of the bottle. This can be achieved by rotating or swiveling a filling element in a controlled manner around an axis oriented tangentially to the direction of rotation of the rotor and thus perpendicular to the action of the centrifugal force. As the rotor spins faster, the dispensing opening tilts more towards the machine axis. The angle of tilt depends at least in part on the centrifugal force and is selected so that, despite the deflection, the jet enters the container through the middle of its mouth.

In some embodiments, a servo drive or actuator carries out compensation for centrifugal force and the corresponding shift of the filling element and/or the container carrier is carried. In some embodiments, the actuator or drive is provided independently for each filling station. In others, an actuator installation jointly controls all the filling stations of the filling machine while the filling elements are in a dead zone that is not used for filling. This dead zone is generally between the container outlet and the container inlet.

In some embodiments, the controller sets the deflection compensation only while the filling element is in the dead zone.

As used herein, the expression "substantially" means deviations from exact values by ±10%, and preferably by ±5%, and/or deviations in the form of changes not significant for functioning.

Further developments, benefits, and application possibilities of the invention arise also from the following description of examples of embodiments and from the figures. All characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

These and other features and advantages of the invention will be apparent from the following detailed description and the accompanying figures in which.

DETAILED DESCRIPTION

Figure 1:
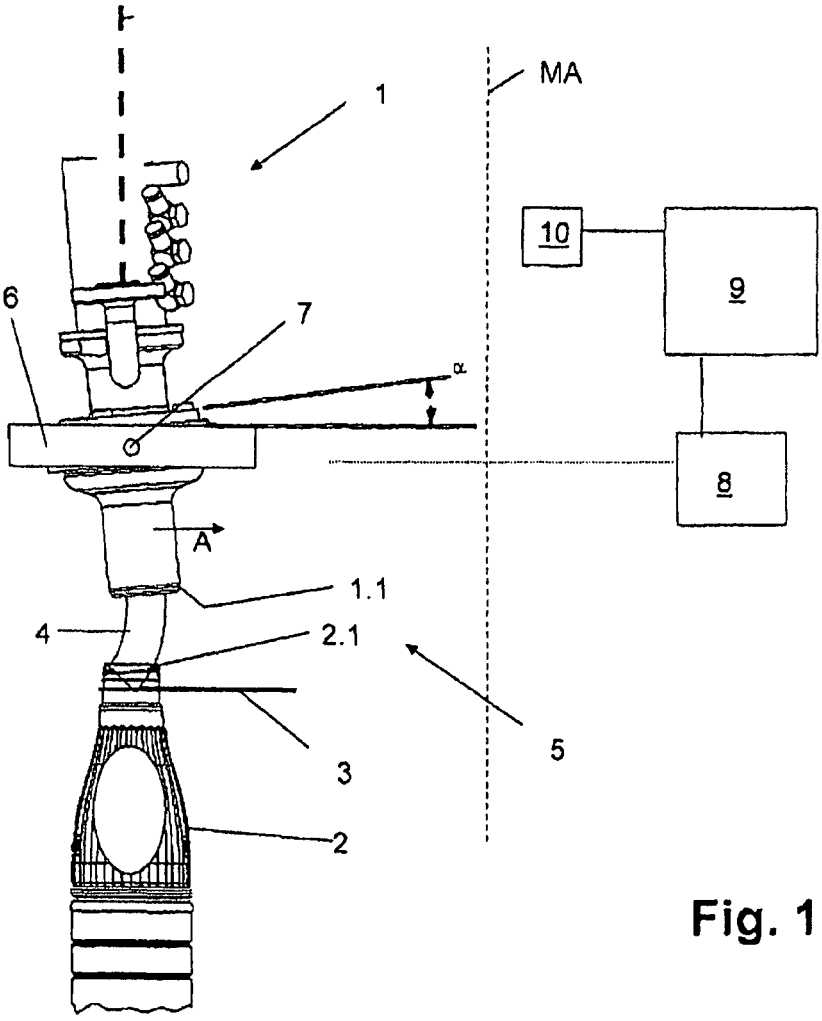
FIG. 1 shows a filling station for the open jet filling of bottles in a view tangential to the movement path of movement of the filling station around a vertical machine axis.
Figure 2:
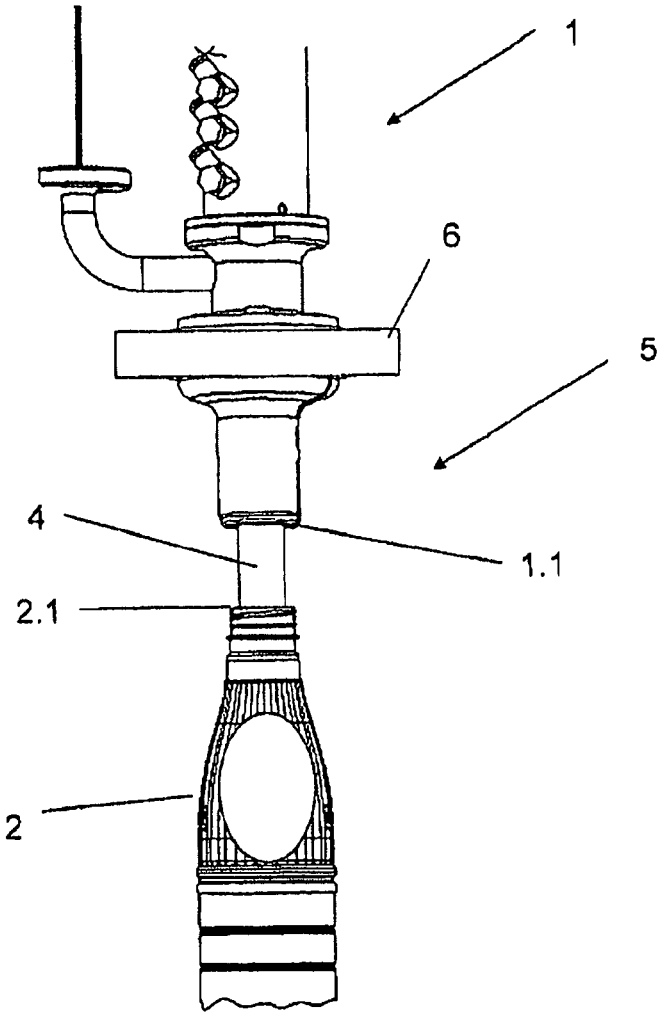
FIG. 2 shows a view of the filling station in FIG. 1 in a radial view relative to the machine axis.

FIGS. 1 and 2 show a filling element 1 from a rotating filling machine. In FIG. 1, the view is from the tangential direction; in FIG. 2, the view is from the radial direction.

The particular filling element 1 directs an open jet 4 of liquid filling-material with which to fill bottles 2. This jet 4 emerges from a dispensing opening 1.1 formed at the bottom of the filling element 1.

Each filling element 1 has an associated container carrier 3 that suspends a bottle 2 with its bottle axis in a vertical direction and parallel to a machine axis MA of the filling machine. As a result, the bottle's mouth lies beneath the filling element 1 at a distance from the dispensing opening 1.1.

Each filling element 1 extends along a filling element axis. This filling element axis can be, but need not be, parallel to the machine axis MA.

The filling element 1 and the container carrier 3 together form a filling station 5 that is one of a plurality of similar filling stations 5 arranged on the circumference of a rotor 6 of the filling machine. The rotor 6 has a vessel, not illustrated, that is filled with the liquid filling-material to be placed into bottles. This vessel connects to each filling element 1.

To ensure a high throughput of filled bottles, the rotor 6 should rotate as quickly as possible and the jet 4 should be as wide as possible. Unfortunately, as the rotor 6 spins faster, it generates more centrifugal force. This tends to deflect the jet 4 radially outward. This outward deflection can be seen in FIG. 1 by a bend in the jet's path.

It is apparent that when the rotor 6 spins, the jet 4 will no longer enter through the center of the bottle's mouth 2.1. As the rotor 6 spins faster, the jet 4 will miss the center of the opening by even more. At higher rotor speeds, the peripheral portion of jet 4 will start to miss the bottle's mouth. Eventually, if the rotor 6 spins fast enough, the jet 4 will completely miss the mouth 2.1.

As shown in FIG. 1, the filling element 1 compensates for the deflection caused by the centrifugal force. It does so by moving the dispensing opening 1.1 radially inward so that it becomes closer to the machine axis MA. As a result, the dispensing opening 1.1 lies between the machine axis MA and the bottle's mouth.

In the illustrated embodiment, the filling element 1 swivels about a swivel axis 7 that is disposed above the dispensing opening 1.1. This tilting causes the filling element's axis to tilt by a swivel angle α relative to the plane of the rotor 6. This brings the dispensing opening 1.1 closer to the machine axis MA.

The swivel angle α depends at least in part on the rotor's speed of rotation. As the rotor 6 spins faster, the swivel angle α increases. As a result, the radial distance of the dispensing opening 1.1 from the machine axis MA decreases in order for the bottle's mouth to catch the jet 4.

A control system for controlling the swivel angle includes a sensor 10, a controller 9, and an actuator 8. The sensor 10 measures the rotor's speed and provides it to the controller 9. The controller 9 then determines an appropriate swivel angle and causes the actuator 8 to swivel the filling element 1 appropriately.

The rotor's speed need not be the only factor that the controller 9 takes into account when compensating for centrifugal force. In some embodiments, the controller 9 takes into account such parameters as the shape and size of the bottle 2, and thus the distance of the bottle's mouth 2.1 from the underside of the filling element 1 or the dispensing opening 1.1, and the type of contents.

Some embodiments avoid the need for flexible or movable product pipes by supplying the filling material through the swivel axis 7. In these embodiments, the swivel axis 7 is configured in a manner similar to known rotary openings for fluids through a central filling-material feed of a rotating filling machine.

During the filling operation, the rotor 6 moves at a constant speed. Therefore, the jet 4 deflects only in a radial direction. It does not deflect in a tangential direction. The absence of tangential deflection can be seen in FIG. 2.

In some embodiments, the actuator 8 is a compound actuator that has plural actuating elements.

In a typical rotary filling machine, the rotor 6 carries a filling element 1 past a container inlet, where it picks up an empty container and begins to fill it. It then carries the filling element 1 past a container outlet, by which time the container is full and can be discharged. Between the outlet and the inlet, the filling element 1 has no container to fill. This angular range, during which the filling element 1 is inactive, is referred to herein as a "dead zone."

In some embodiments, the actuator 8 sets the swivel angle using a control cam while the filling element 1 is in the dead zone. The relevant setting of the filling element 1 is then locked or fixed until the rotor 6 brings the filling element 1 back to the dead zone, whereupon, if applicable, the actuator corrects the swivel angle α.

Figure 3:
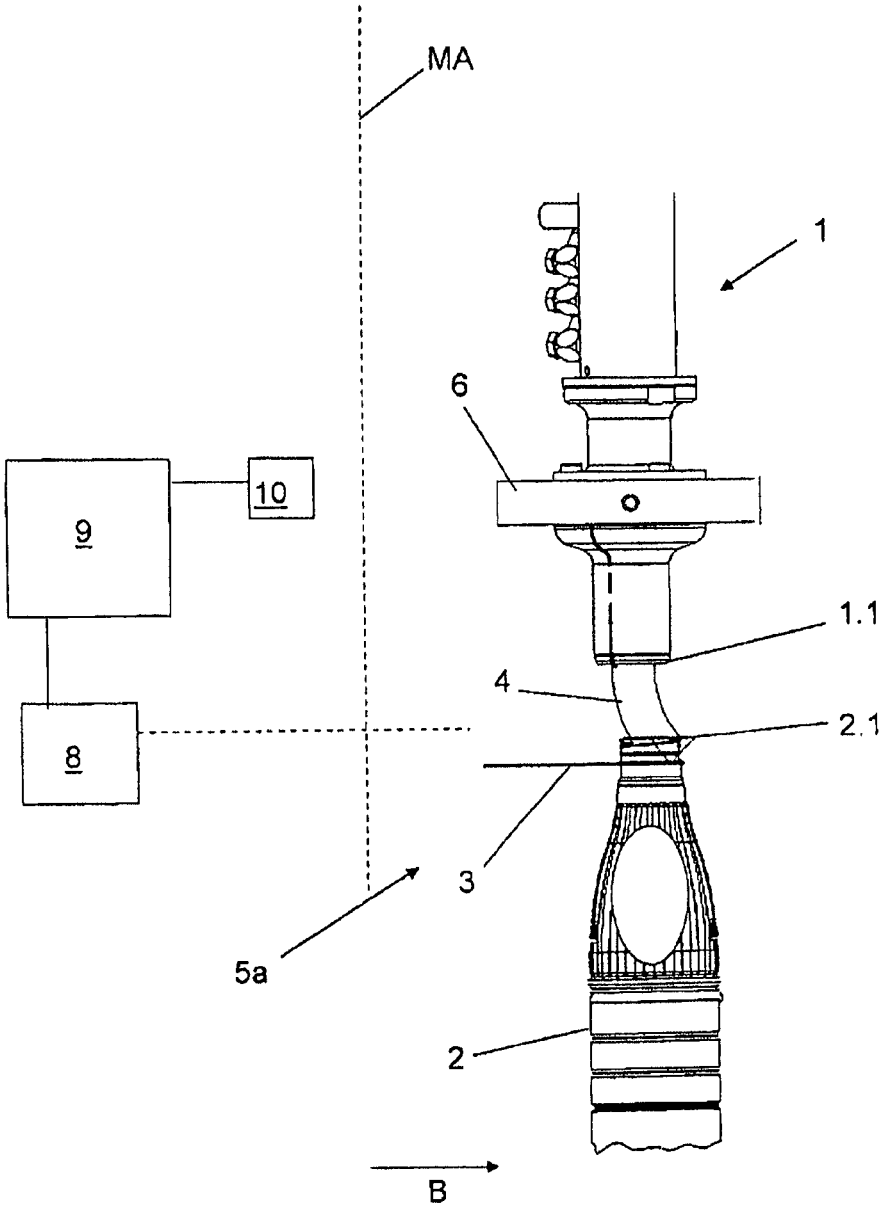
FIGS. 3 and 4 show views along the lines set forth in FIGS. 1 and 2 for an alternative filling station.
Figure 4:
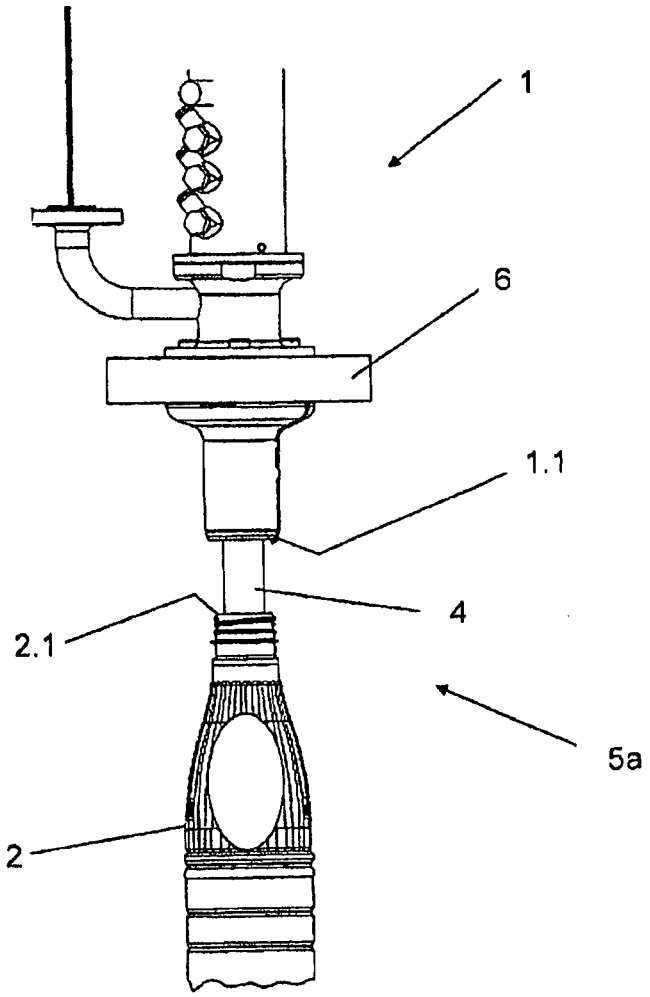

FIGS. 3 and 4 show an alternative embodiment of a filling station 5*a* that is one of a plurality of similar filling stations on the circumference of a rotor 6 that rotates about a vertical machine axis MA during filling. The filling station 5*a* compensates for centrifugal force compensation without swiveling. Instead, the actuator 8 moves the container carrier 3, and thus the bottle 2 held on the container carrier 3, radially outwards relative to the machine axis MA along the direction B. The extent of this movement again depends at least in part on the rotor's rotational speed.

The invention was described above using examples of embodiments. It is clear that modifications and variations are possible without thereby departing from the inventive idea underlying the invention.

In the embodiments described thus far, the controller compensates for deflection of the jet 4 by centrifugal forces by moving the filling element 1 or the dispensing opening 1.1 closer to the machine axis MA so that the dispensing opening lies between the bottle's mouth and the machine axis MA. In FIGS. 1 and 2, the controller achieves this by swiveling. In FIGS. 3 and 4, the controller achieves this by moving the bottle 2 away from the machine axis MA.

Other movements of the filling element 1 and/or the bottle 2 are possible to compensate for centrifugal force.

For example, instead of swiveling the filling element 1, one can swivel the container carrier 3, and thus the bottle 2 held on it around an axis that extends in a direction tangential to the rotor's direction of rotation. The controller controls this swivel movement such that the jet 4 enters the bottle 2 completely through the bottle's mouth 2.1, and the axis that the jet 4 has at the bottle's mouth 2.1 is the same time the bottle axis. The controller achieves this by controlled movement of the filling element 1 relative to the bottle 2.

Having described the invention, and a preferred embodiment thereof, what is claimed as new, and secured by Letters Patent is:

1. A method for open jet filling of containers with liquid content using a filling machine having a rotor that rotates around a vertical machine axis, wherein said rotor carries filling stations, wherein each filling station comprises a filling element, wherein each filling element comprises a dispensing opening and a container carrier, wherein said container carrier holds a container such that a container opening of said container is disposed at a selected distance from said dispensing opening of said corresponding filling element so that contents dispensed in a controlled manner by said filling element flow in an open filling jet directed toward said container opening, said method comprising compensating for a deflection of said filling jet due to centrifugal force acting on said filling jet when said rotor rotates, wherein compensating for said deflection of said filling jet due to centrifugal force comprises causing a controlled relative movement between said filling element and said container, wherein, as a result of said controlled relative movement, said open jet enters said container completely and said open jet is centered within said container opening, wherein causing a controlled relative movement comprises moving one of said filling element and said dispensing opening radially toward said machine axis to an extent that depends on speed of said rotor, wherein moving one of said filling element and said dispensing opening radially toward said machine axis to an extent that depends on speed of said rotor comprises swiveling said filling element around a swivel axis, wherein said swivel axis is oriented tangentially to a direction of rotation of said rotor, and wherein said swivel axis is disposed above said dispensing opening.

2. The method of claim 1, wherein moving one of said filling element and said dispensing opening radially toward said machine axis to an extent that depends on speed of said rotor comprises causing radial movement of said filling element.

3. The method of claim 1, wherein causing a controlled relative movement between said filling element and said container comprises detecting an increase in rotor speed, and, in response to said increase in rotor speed, moving one of said filling element and said dispensing opening radially toward said machine axis, thereby causing a radial distance between said dispensing opening and said machine axis to decrease.

4. The method of claim 1, wherein causing a controlled relative movement comprises moving said container radially to an extent that depends on speed of said rotor.

5. The method of claim 4, wherein moving said container radially comprises causing radial movement of said container such that a radial distance between said machine axis and said container increases when rotor speed increases.

6. The method of claim 4, wherein moving said container radially comprises swiveling said container around a swivel axis, wherein said swivel axis is oriented tangentially to a direction of rotation of said rotor, and wherein said swivel axis is disposed above said dispensing opening such that a swivel angle increases as rotor speed increases.

7. The method of claim 1, wherein causing a controlled relative movement between said filling element and said container comprises, based on a speed of said rotor, causing controlled relative movement that causes an axial direction of said open filling jet, upon entry into said container, to be oriented parallel to an axis of said container opening.

8. The method of claim 1, wherein causing controlled relative motion comprises causing said dispensing opening to be at a first distance from said machine axis and causing said container to be at a second distance from said machine axis, wherein said second distance is greater than said first distance.

9. The method of claim 8, further comprising selecting a difference between said first distance and said second distance based at least in part on how fast said rotor rotates.

10. The method of claim 9, wherein selecting a difference between said first distance and said second distance based at least in part on how fast said rotor rotates comprises selecting said first distance to be a first value when said rotor rotates at a first rotational speed, and selecting said first distance to be a second value when said rotor rotates at a second rotational speed, wherein said second rotational speed is greater than said first rotational speed, and said second value is greater than said first value.

11. The method of claim 8, wherein causing said dispensing opening to be at a first distance from said machine axis and causing said container to be at a second distance from said machine axis, wherein said second distance is greater than said first distance comprises moving said dispensing opening.

12. An apparatus for open jet filling of containers, said apparatus comprising a circulating filling machine, said circulating filling machine comprising a rotor that rotates around a vertical machine axis, and a plurality of filling stations provided on said rotor, each of said filling stations comprising a filling element, and a container carrier for holding a container with a container opening thereof at a selected distance under a dispensing opening of said filling element so that contents dispensed in a controlled manner by said filling element flow in an open filling jet during filling of said container, said filling machine further comprising an actuator configured to compensate for deflection of said open filling jet caused by centrifugal forces due to the rotation of said rotor wherein said actuator causes a structure to engage in a controlled movement in a radial direction relative to said machine axis, said movement being dependent on a speed of said rotor, wherein said structure is selected from the group consisting of a filling element and a container carrier holding a container, wherein said controlled movement results in a change in a distance between a portion of said structure and said machine axis as a result of swiveling of said structure around a swivel axis that is oriented tangentially to a direction of rotation of said rotor and above said filling element.

13. The apparatus of claim 12, further comprising a pipe connecting said filling elements to a source of fluid.

14. The apparatus of claim 12, wherein said pipe is a flexible and telescopic pipe.

15. The apparatus of claim 14, wherein said pipe is a U-shaped pipe.

16. The apparatus of claim 14, wherein said pipe is a S-shaped pipe.

17. The apparatus of claim 12, wherein said actuator is common to all filling elements on said rotor.

18. The apparatus of claim 12, further comprising an actuation installation for setting centrifugal force compensation of at least one of said filling elements and said container carriers, wherein said actuation installation is common to at least one of all filling elements and all container carriers of said filling machine that are within an angular range of rotational movement of said rotor, said angular range being between a container outlet and a container inlet, wherein said angular range is not used for container filling, wherein said actuation installation performs compensation for centrifugal force, wherein said filling stations comprise means for fixing or locking a relevant setting of centrifugal force compensation at a filling station until said filling station is carried by said rotor to said angular range.

* * * * *